US006802790B2

(12) United States Patent
Pohrer

(10) Patent No.: US 6,802,790 B2
(45) Date of Patent: Oct. 12, 2004

(54) ADJUSTABLE HEIGHT BASKETBALL BACKBOARD

(75) Inventor: Christopher M. Pohrer, St. Louis, MO (US)

(73) Assignee: Aalco Manufacturing Co., St. Louis, MO (US)

( * ) Notice: Subject to any disclaimer, the term of this patent is extended or adjusted under 35 U.S.C. 154(b) by 0 days.

(21) Appl. No.: 10/086,292

(22) Filed: Mar. 1, 2002

(65) Prior Publication Data

US 2002/0082127 A1 Jun. 27, 2002

Related U.S. Application Data

(63) Continuation-in-part of application No. 09/439,730, filed on Nov. 12, 1999, now Pat. No. 6,368,240.

(51) Int. Cl.[7] ..... A63B 63/08
(52) U.S. Cl. ..... 473/483
(58) Field of Search ..... 473/483; 248/539, 248/219.4, 274.1

(56) References Cited

U.S. PATENT DOCUMENTS 5,279,496 A * 1/1994 Schroeder ..... 473/483
5,800,296 A * 9/1998 Shaw ..... 473/483
5,947,849 A * 9/1999 Ellenbaum ..... 473/483
5,984,811 A * 11/1999 Taylor ..... 473/483
6,056,654 A * 5/2000 Schroeder ..... 473/483

* cited by examiner

*Primary Examiner*—William M. Pierce
(74) *Attorney, Agent, or Firm*—Armstrong Teasdale LLP

(57) ABSTRACT

A basketball backboard assembly includes a basketball backboard, a hollow member, a second member, and an actuator. The hollow member is connected to the basketball backboard, and includes an outer surface and an inner surface. The second member is located at least partially within the hollow member and in slidable contact with the hollow member. The second member includes an outer surface and an inner surface, and at least one of the hollow member outer and inner surfaces defines a cross-sectional profile for the hollow member that is substantially similar to that of a cross-sectional profile defined by at least one of the second member outer and inner surfaces. The actuator is connected to the second member and the hollow member, and provides for relative movement between the second member and the actuator member.

17 Claims, 6 Drawing Sheets

ADJUSTABLE HEIGHT BASKETBALL BACKBOARD

CROSS REFERENCE TO RELATED APPLICATIONS

This application is a Continuation-In-Part of U.S. patent application Ser. No. 09/439,730, filed Nov. 12, 1999 now U.S. Pat. No. 6,368,240.

BACKGROUND OF THE INVENTION

This invention relates generally to basketball backboards and, more particularly, to adjustable height mounting systems for basketball backboards.

A basketball backboard is normally supported from above so that a basketball rim mounted to the backboard is positioned at a height of ten feet above a floor. This height is formidable for shorter players and nearly impossible for children. Adjustable-height backboard supports permit the basketball backboard to be lowered so that the basketball rim is positioned at a height of eight feet for grade-school gymnasiums. Unfortunately, typically, these basketball backboard assemblies require tedious on-site assembly and the installation of additional support tubing and a crank-type adjustment assembly. Furthermore, often these systems are supported from below, creating a potential hazard near a basketball court.

While these assemblies position a basketball rim eight feet above the ground, the assemblies typically require continuous maintenance including re-tightening of the installed components. Although crank-type adjustments are installed, the systems are unreliable, time-consuming, and difficult for an individual to adjust. Furthermore, the assemblies are typically not supported as rigidly as the non-modified equipment and over time the additional support tubing fatigues and requires replacement.

Accordingly, it would be desirable to provide a basketball backboard assembly that can be easily adjusted by an individual, does not require continuous maintenance, and is easily adapted to existing overhead basketball backboard assemblies.

BRIEF SUMMARY OF THE INVENTION

In one aspect of the invention, a basketball backboard assembly is provided. The basketball backboard assembly includes a basketball backboard, a hollow member, a second member, and an actuator. The hollow member is connected to the basketball backboard, and includes an outer surface and an inner surface. The second member is located at least partially within the hollow member and in slidable contact with the hollow member. The second member includes an outer surface and an inner surface, and at least one of the hollow member outer and inner surfaces defines a cross-sectional profile for the hollow member that is substantially similar to that of a cross-sectional profile defined by at least one of the second member outer and inner surfaces. The actuator is connected to the second member and the hollow member, and provides for relative movement between the second member and the actuator member.

In another aspect, a method for mounting a backboard assembly to a structural foundation is provided. The backboard assembly includes a support system. The method comprises attaching a hollow member including inner and outer surfaces to the backboard assembly, slidably coupling a second member including inner and outer surfaces to the hollow member, wherein a cross-sectional profile of the second member defined by at least one of the second member inner and outer surfaces is substantially similar to a cross-sectional profile of the hollow member defined by at least one of the hollow member inner and outer surfaces, and attaching the backboard to the support system.

DETAILED DESCRIPTION OF THE INVENTION

Figure 1:
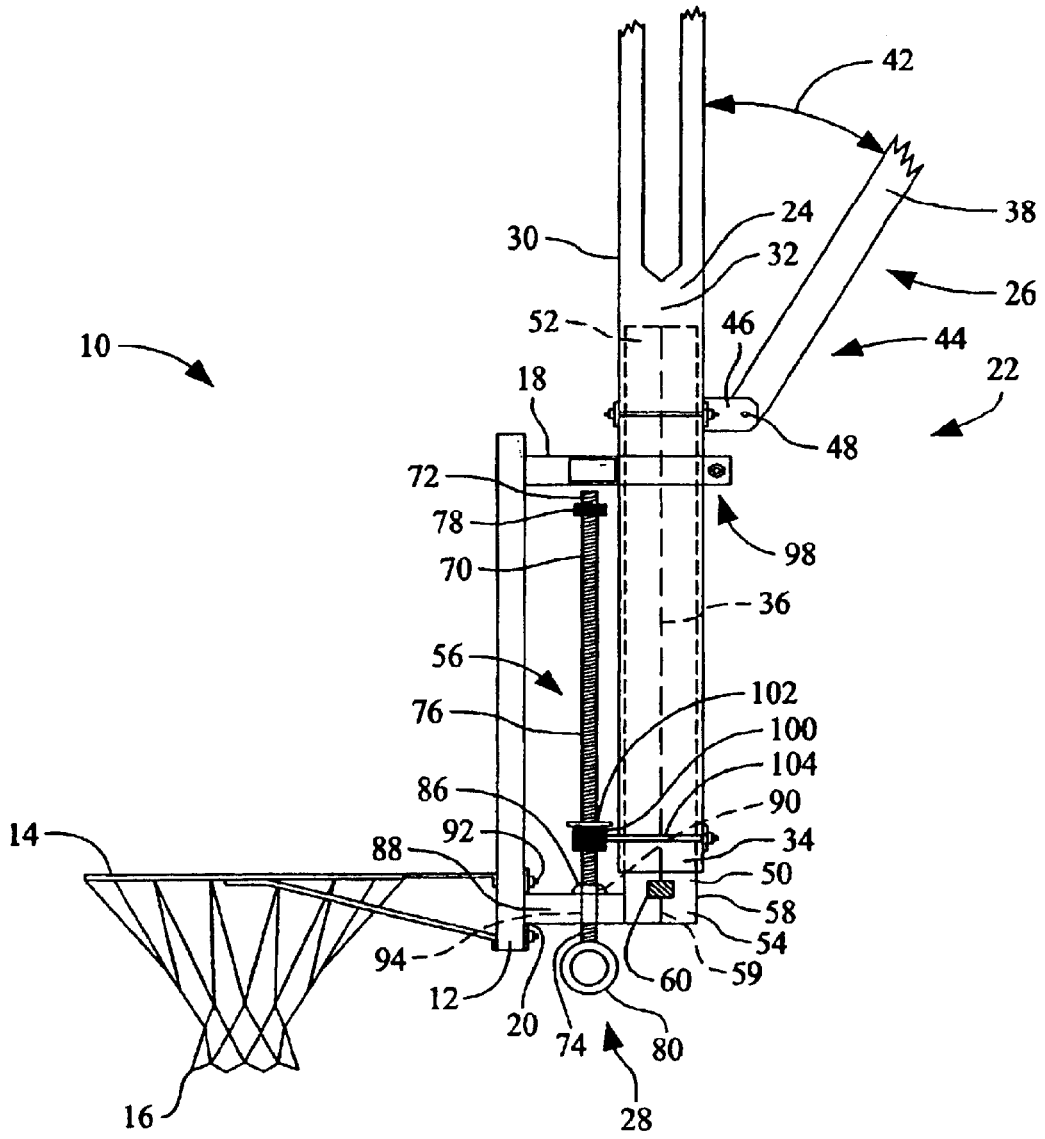
FIG. 1 is a side view of a mounting system for supporting a basketball backboard in accordance with one embodiment of the present invention.

FIG. 1 is a side view of a mounting system 10 for supporting a basketball backboard 12 including a basketball rim 14 mounted substantially parallel to a floor (not shown) and net 16 hanging from rim 14. Basketball backboard 12 includes an upper attachment 18 and a lower attachment 20. Mounting system 10 includes a support system 22 including a stationary member 24, an angled support assembly 26, and an actuator system 28. Stationary member 24 is hollow and includes an outer surface 30 and an inner surface (not shown in FIG. 1). Stationary member 24 also includes a first end 32, a second end 34, and an axis of symmetry 36 extending from first end 32 to second end 34. Stationary member 24 is mounted such that axis of symmetry 36 extends in a direction substantially perpendicular to the floor.

Angled support assembly 26 includes a first angled support member 38 and a second angled support member (not shown in FIG. 1). First angled support member 38 is mounted to stationary member 24 at an oblique angle 42 with respect to axis of symmetry 36. Angled support system 26 includes a bracket assembly 44. Bracket assembly 44 includes a bracket clamp 46 attached to stationary member 24. First angled support member 38 is attached to bracket clamp 46 with a pin 48 such that angled support system 26 is capable of retracting stationary member 24 which causes backboard 12 to be suspended such that backboard 12 is substantially parallel to the floor. The second angled support member is attached to stationary member 24 in a similar manner.

Actuator system 28 includes an adjustable or second member 50 having a first end 52 and a second end 54, and a drive mechanism assembly 56. Adjustable member 50 is a telescoping member that is hollow and tubular and includes an outer surface 58. Adjustable member 50 includes an axis of symmetry 59 which extends from first end 52 to second end 54. Adjustable member 50 is positioned within stationary member 24 in slidable contact. In one embodiment, outer surface 58 of adjustable member 50 is in slidable contact with the inner surface of stationary member 24. In a second embodiment, outer surface 30 of stationary member 24 is in slidable contact with the inner surface (not shown) of adjustable member 50. Outer surface 58 of adjustable member 50 also includes a plurality of markings 60 which indicate the height that rim 14 is positioned above the floor after adjustable member 50 is positioned.

Drive mechanism assembly 56 includes a rod 70 having a first end 72 and a second end 74. Rod 70 has a plurality of threads 76 attached and extending from first end 72 to second end 74. In another embodiment, rod 70 is a hydraulic cylinder assembly (not shown). First end 72 includes a thread stop 78 which limits the downward movement of adjustable member 50. Second end 74 includes a closed eyelet loop 80 which accepts a crank end (not shown) for adjusting the height of basketball rim 14 above the floor. In another embodiment, second end 74 accepts a pneumatic air wrench (not shown).

Drive mechanism assembly 56 also includes a thrust bearing 86 mounted to a fixed bracket 88 and including an opening 90. Thrust bearing 86 prevents axial movement of backboard 12. Fixed bracket 88 is attached between adjustable member 50 at second end 54 and backboard 12 at lower attachment 20. A plurality of threaded connectors 92 extend through backboard 12 and connect rim 14 to fixed bracket 88. Attaching rim 14 to fixed bracket 88 eliminates an amount of potential strain which would be induced on backboard 12 if fixed bracket 88 was attached directly to backboard 12.

Fixed bracket 88 includes an opening 94. Thrust bearing or collar 86 is mounted to fixed bracket 88 such that opening 90 is positioned concentrically over opening 94 so that rod 70 can extend therethrough. Opening 94 is sized to receive rod 70, but closed eyelet loop 80 cannot fit within opening 94 and as such, closed eyelet loop 80 is a limit to the upward movement of adjustable member 50. For example, when closed eyelet loop 80 is in a position of close proximity to second end 34 of stationary member 24, as shown in FIG. 1, the height of backboard 12 from the floor is maximized and mounting system 10 is in a "fully elevated" position. In one embodiment, a maximized height of rim 14 when backboard 12 is in a "fully elevated" position is 10 feet above the floor.

Figure 5:
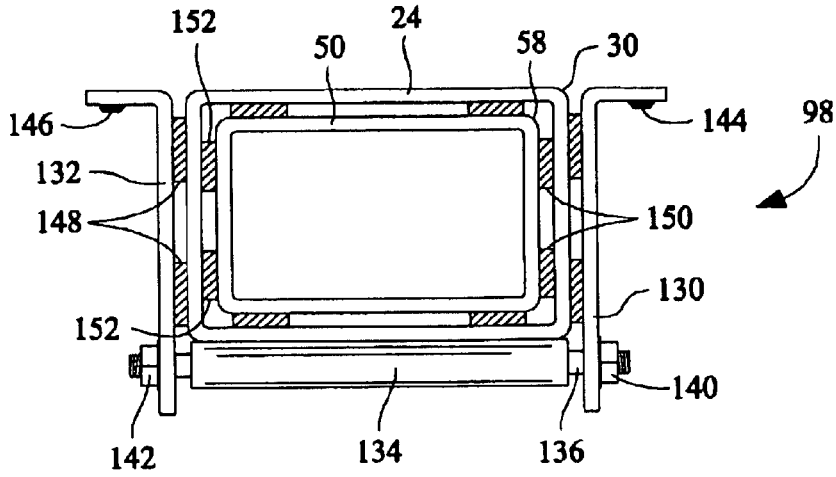
FIG. 5 is an enlarged view of one of the roller assemblies as seen from above.

Drive mechanism assembly 56 also includes a roller assembly 98 and a stationary nut 100 including an opening 102 which receives threads 76 of rod 70. Opening 102 is sized so that rod 70 is received therethrough, but thread stop 78 cannot fit within opening 102. Thread stop 78 prevents rod 70 from slipping through nut 100. Opening 102 is also sized such that as rod 70 is adjusted upwardly, thrust bearing 86 will contact stationary nut 100 and will not enter opening 102. Nut 100 is fixedly mounted to a bracket 104 attached to stationary member 24 in close proximity to second end 34. Accordingly, nut 100 and bracket 104 form a stationary assembly. Drive mechanism assembly 56 is positioned such that rod 70 extends through fixed bracket 88 and thrust bearing 86 into stationary nut 100 in a direction substantially parallel to axis of symmetry 36. Roller assembly 98, described below in FIG. 5, is attached to backboard 12 at upper attachment 18 and is slidably attached to stationary member 24.

Figure 2:
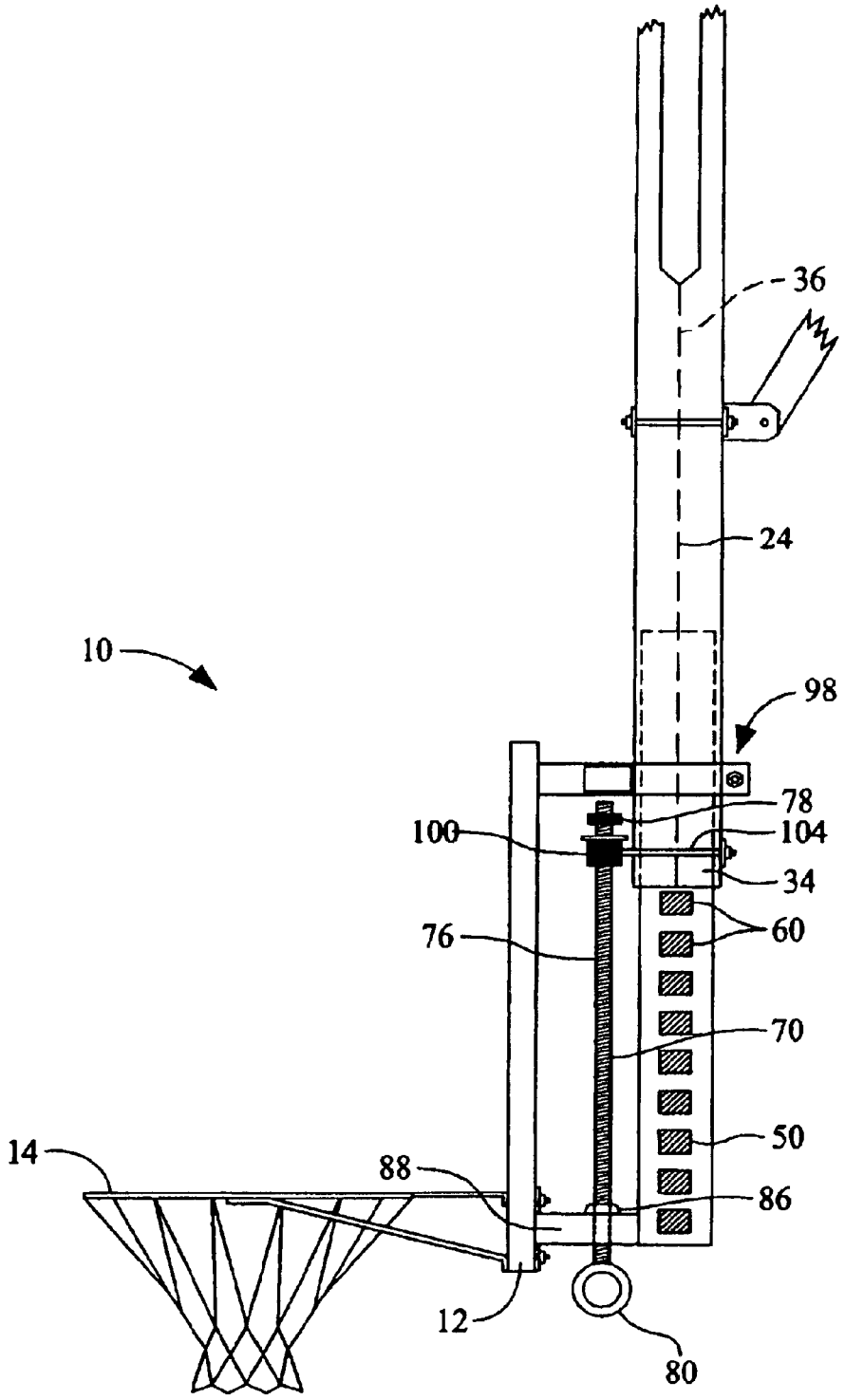
FIG. 2 is a side view of the mounting system shown in FIG. 1 in a lowered position.

FIG. 2 is a side view of mounting system 10 in which closed eyelet loop 80 is positioned in distant proximity to second end 34 of stationary member 24. When closed eyelet 80 has been fully rotated clockwise, thread stop 78 contacts stationary nut 100 and stops the rotation of rod 70 and the downward movement of adjustable member 50. The height of backboard 12 from the floor is minimized and mounting system 10 is in a "fully lowered" position. In a one embodiment, rim 14 is 8 feet above the floor when mounting system 10 is in a "filly lowered" position.

In operation, a crank end (not shown) is upwardly extended and inserted into closed eyelet loop 80. The crank is rotated counter-clockwise to raise rim 14 and clockwise to lower rim 14. The movement of rod 70 is limited in a counter-clockwise direction by thrust bearing 86 and in a clockwise direction by thread stop 78. As the crank is rotated clockwise, closed eyelet loop 80 is rotated which causes rod 70 to rotate. As rod 70 rotates, threads 76 are rotated clockwise through stationary nut 100 causing rod 70 to extend downwardly towards the floor in a direction parallel to axis of symmetry 36. As rod 70 extends downward, fixed bracket 88 and roller assembly 98 slide downward causing adjustable member 50 to simultaneously extend downward. The crank is continuously rotated until marking 60 indicates that adjustable member 50 is positioned at a desired height for rim 14. To raise rim 14, the crank is continuously rotated counter-clockwise until marking 60 indicates that adjustable member 50 has positioned rim 14 at a desired height.

Figure 3:
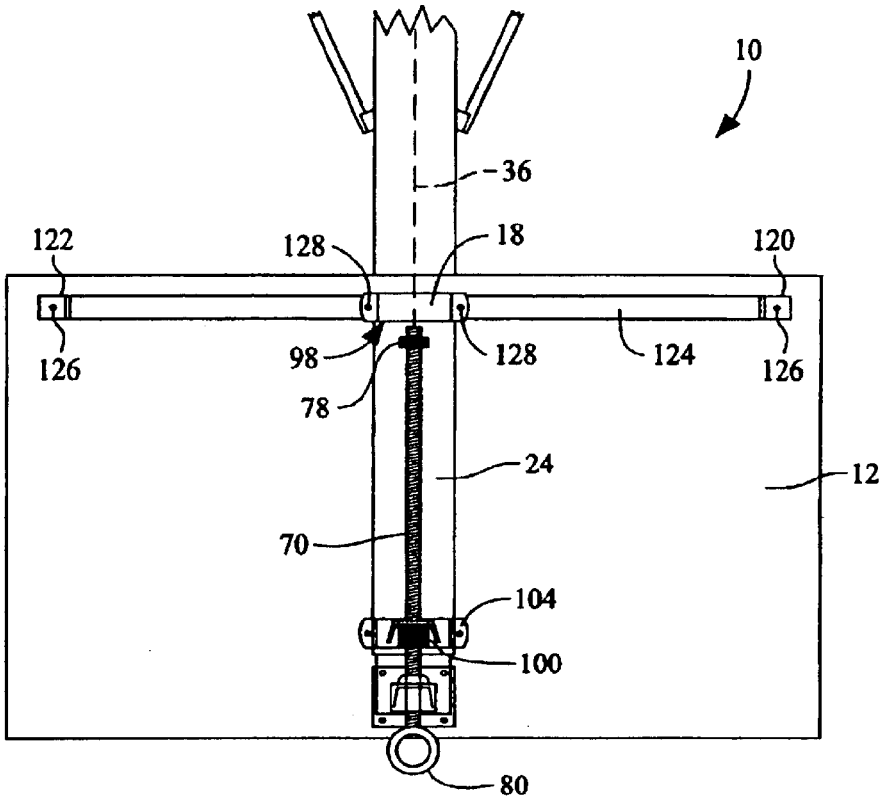
FIG. 3 is a front view of the mounting system shown in FIG. 1 without a basketball rim attached.

FIG. 3 is a front view of mounting system 10 and includes upper attachment 18 and backboard 12 without basketball rim 14 attached. Upper attachment 18 includes a pair of backboard brackets 120 and 122, and a backboard brace 124. Backboard brace 124 is mounted substantially parallel to a floor and extends between backboard brackets 120 and 122. Backboard brace 124 is positioned between backboard 12 and first stationary member 24 and provides support to backboard 12. Backboard brace 124 also reduces torsional and rotational stresses on backboard 12. Backboard brackets 120 and 122 extend substantially perpendicularly from backboard 12 and are mounted at a distant proximity from axis of symmetry 36 using a set of threaded connectors 126. Roller assembly 98 is attached to backboard brace 124 using a set of threaded connectors 128.

Figure 4:
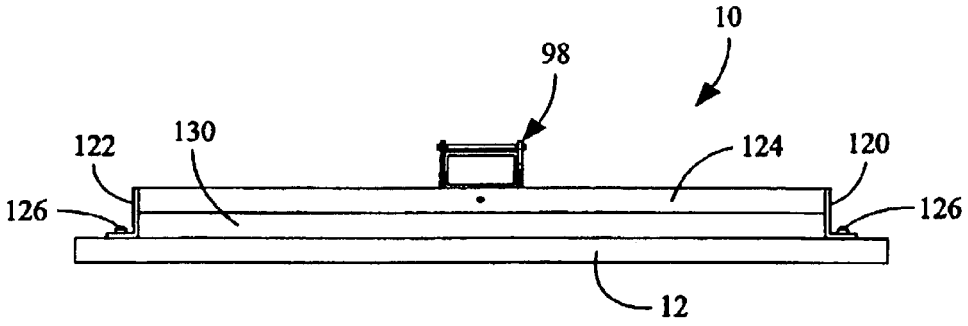
FIG. 4 is a plan view of the mounting system shown in FIG. 3.

FIG. 4 is a plan view of mounting system 10 including backboard 12 without rim 14 attached. Backboard brace 124 is mounted to brackets 120 and 122 and is substantially perpendicular to stationary member 24. Brackets 120 and 122 extend from backboard 12 and create a gap 130 between backboard brace 124 and backboard 12.

FIG. 5 is an enlarged view of roller assembly 98 as seen from above. Roller assembly 98 includes a first bracket 130, a second bracket 132, and a roller mechanism 134. Roller mechanism 134 is mounted on an axle 136 which is mounted between brackets 130 and 132 with threaded connectors 140 and 142. Roller mechanism 134 is positioned in slidable contact with outer surface 30 of stationary member 24. Brackets 130 and 132 are positioned adjacent outer surface 30 and are mounted to backboard brace 124 (shown in FIG. 4) using connectors 144 and 146. Roller mechanism 134 also includes a set of bearing plates 148 mounted to first bracket 130 between first bracket 130 and outer surface 30 of stationary member 24 and mounted to second bracket 132 between second bracket 132 and outer surface 30 of stationary member 24. Bearing plates 148 provide a smooth surface 149 between roller mechanism 134 and stationary member 24. Bearing plates 148 are fabricated from Teflon® matierial. Alternatively, bearing plates 148 are manufactured from Special Tivar 1000® material.

Adjustable member 50 also includes a set of bearing plates 150 mounted to outer surface 58 and positioned between outer surface 58 and the inner surface of stationary member 24. Bearing plates 150 provide a smooth surface 152 between adjustable member 50 and stationary member 24. Bearing plates 150 are fabricated from cold rolled steel that is greased and oiled.

Stationary member 24 and adjustable member 50 are fabricated from similarly shaped members to prevent either member 24 or 50 from rotating with respect to the other member 50 or 24. In one embodiment stationary member 24 is fabricated of 5"×7" rectangular steel tubing and adjustable member 50 is fabricated from 4.5"×6.5" rectangular steel tubing. In another embodiment, stationary member 24 and adjustable member 50 are fabricated from steel tubing having a circular cross-sectional area.

In another mounting embodiment, mounting system 10 includes stationary member 24 and does not include adjustable member 50. Rather, a second roller assembly (not shown) is attached to stationary member 24 in close proximity to roller assembly 98. Lower attachment 20 is attached to a support brace assembly (not shown) mounted to backboard 12. The support brace assembly comprises a first member (not shown) positioned substantially parallel to the floor and a plurality of members (not shown) extending upwardly from the first member and connected to bracket 124. The support brace assembly provides support to backboard 12 and alleviates potential torsional and twisting forces on backboard 12.

Figure 6:
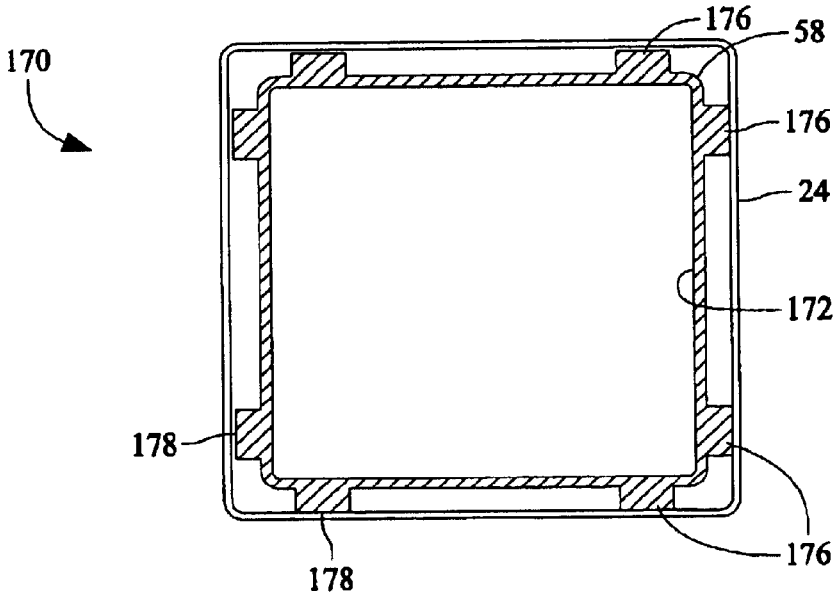
FIG. 6 is an enlarged view of an alternative embodiment of an adjustable member that may be used with the mounting system shown in the above figures.

FIG. 6 is an enlarged view of an alternative embodiment of an adjustable member 170 that may be used with mounting system (shown in FIGS. 1–4). Adjustable member 170 is substantially similar to adjustable member 50 shown in FIGS. 1–5 and components of adjustable member 170 that are identical to components of adjustable member 50 are identified in FIG. 6 using the same reference numerals used in FIGS. 1–5. Accordingly, adjustable member 170 is a telescoping member that is hollow and tubular and includes an outer surface 58. Furthermore, adjustable member 170 is positioned within stationary member 24 in slidable contact. In the exemplary embodiment, member 170 has a substantially square cross-sectional profile defined by an inner surface 172 of member 170. More specifically, similarly to member 50, an inner cross-sectional profile of member 170 is shaped substantially identically with an inner cross-sectional profile of member 24.

Adjustable member 170 also includes a set of bearing plates or projections 176 extending outwardly from member outer surface 58 and positioned between outer surface 58 a and the inner surface of stationary member 24. Bearing plates 170 provide a smooth surface 178 between adjustable member 170 and stationary member 24. Bearing plates 176 are formed integrally with member 170. In the exemplary embodiment, bearing plates 176 are formed with member 170 using an extrusion process. In an alternative embodiment, bearing plates 176 are formed integrally with member 24. In a further alternative embodiment, members 24 and 170 include integrally formed bearing plates 176.

Figure 7:
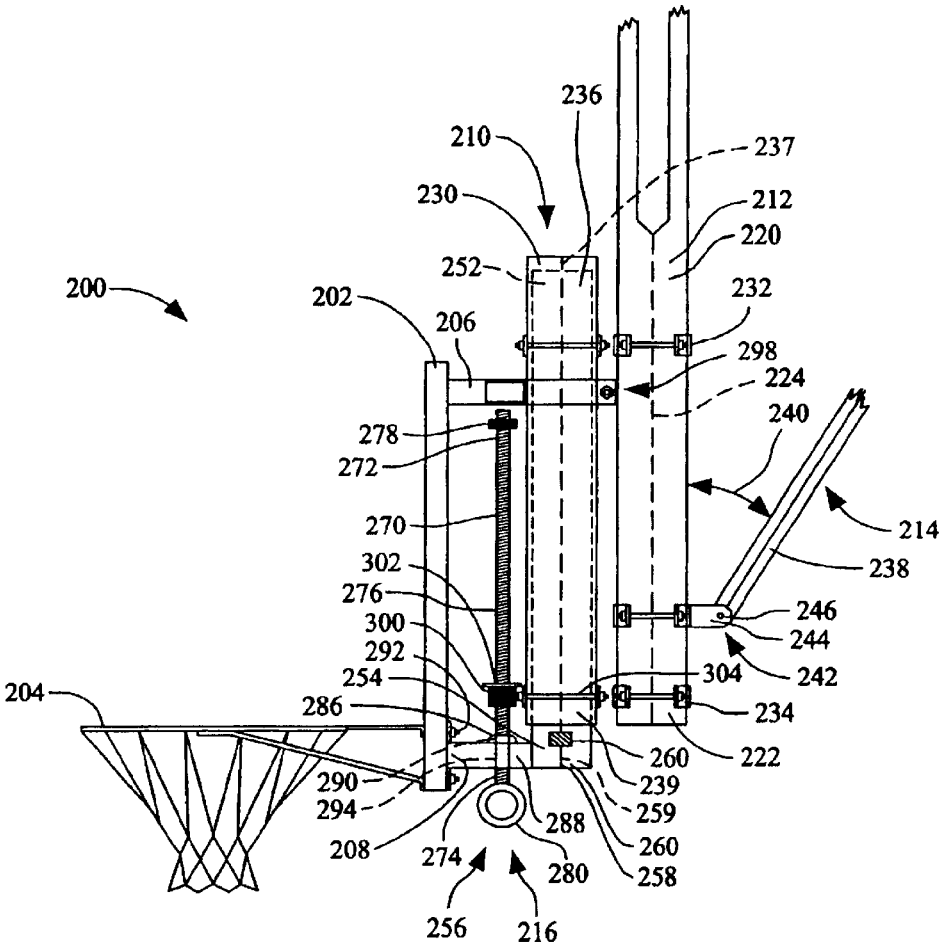
FIG. 7 is a side view of a mounting system for supporting a basketball backboard in accordance with a second embodiment of the present invention.

FIG. 7 is a side view of a mounting system 200 for supporting a basketball backboard 202 including a basketball rim 204 mounted substantially parallel to a floor (not shown). Basketball backboard 202 includes an upper attachment 206 and a lower attachment 208. Mounting system 200 includes a support system 210 including a first stationary member 212, an angled support assembly 214, and an actuator system 216. First stationary member 212 includes a first end 220, a second end 222, and an axis of symmetry 224 which extends from first end 220 to second end 222. A second stationary member 230 is mounted to first stationary member 212 with an upper bracket 232 and a lower bracket 234. Second stationary member 230 is hollow and includes an outer surface 236 and an inner surface (not shown). Second stationary member 230 also includes an axis of symmetry 237 which is substantially parallel to axis of symmetry 224 and a second end 239.

Angled support system 214 includes a first angled support member 238 and a second angled support member (not shown) each mounted to first stationary member 212 at an oblique angle 240 with respect to axis of symmetry 224. Angled support system 214 includes a bracket assembly 242 including a bracket clamp 244 attached to first stationary member 212. Angled support member 238 is attached to bracket clamp 244 with a pin 246 such that angled support system 214 is capable of retracting first stationary member 212 which causes backboard 202 to be suspended substantially parallel to the floor. The second angled support member is attached to first stationary member 212 in a similar manner.

Actuator system 216 includes an adjustable member 250 having a first end 252 and a second end 254 and a drive mechanism assembly 256. Adjustable member 250 is hollow, includes an outer surface 258, and is telescoping. Adjustable member 250 includes an axis of symmetry 259 which extends from first end 252 to second end 254 and is positioned substantially co-axially with axis of symmetry 237. Adjustable member 250 is positioned in slidable contact within second stationary member 230. In one embodiment outer surface 258 is in slidable contact with the inner surface of second stationary member 230.

Adjustable member 250 also includes a plurality of markings 260 attached to outer surface 258 which indicate the height rim 204 is positioned above the floor after adjustable member 250 is positioned. Drive mechanism assembly 256 includes a rod 270 having a first end 272 and a second end 274. Rod 270 has a plurality of threads 276 extending from first end 272 to second end 274. First end 272 includes a thread stop 278 which limits the downward movement of adjustable member 250. Second end 274 includes a closed eyelet loop 280 which accepts a crank end (not shown) for re-positioning rim 204 above the floor.

Drive mechanism assembly 256 also includes a thrust bearing 286 mounted to a fixed bracket 288 and including an opening 290. Thrust bearing 286 prevents axial movement of backboard 202. Fixed bracket 288 is attached between adjustable member 250 at second end 254 and backboard 202. Fixed bracket 288 attaches to basketball rim 204 using threaded connectors 292 which extend from rim 204 through backboard 202 to fixed bracket 288. Attaching rim 204 to fixed bracket 288 alleviates potential strain which would be induced by attaching fixed bracket 288 directly to backboard 202.

Fixed bracket 288 includes an opening 294. Thrust bearing 286 is mounted to fixed bracket 288 such that opening 290 is positioned concentrically over opening 294 and rod 270 extends therethrough. Opening 294 is sized to receive rod 270 therethrough, but closed eyelet loop 280 can not fit within opening 294 and as such, closed eyelet loop 280 limits a distance that adjustable member 250 can be adjusted upwardly. For example, when closed eyelet loop 280 is in a position of close proximity to second end 239 of second stationary member 230, the height of backboard 202 above the floor is maximized and mounting system 200 is in a "fully elevated" position. In a preferred embodiment, rim 204 is 10 feet above the floor when in a "fully elevated" position.

Drive mechanism assembly 256 also includes a roller assembly 298 and a stationary nut 300 including an opening 302 sized to circumferentially receive threads 276 of rod 270. Opening 302 is sized such that rod 270 is received therethrough, but thread stop 278 cannot fit within opening 302 and as such, thread stop 278 prevents rod 270 from slipping through nut 300. Opening 302 is also sized such that as rod 270 is adjusted upwardly, thrust bearing 286 will contact stationary nut 300 and will not enter opening 302. Nut 300 is fixedly mounted to a bracket 304 (shown in Fig. mounted to second stationary member 230. Drive mechanism assembly 256 is positioned such that rod 270 extends through fixed bracket 288 and thrust bearing 286 into stationary nut 300 in a direction substantially parallel to axis of symmetry 236. Roller assembly 298 is attached to backboard 202 at upper attachment 206 and is slidably attached to second stationary member 230.

Figure 8:
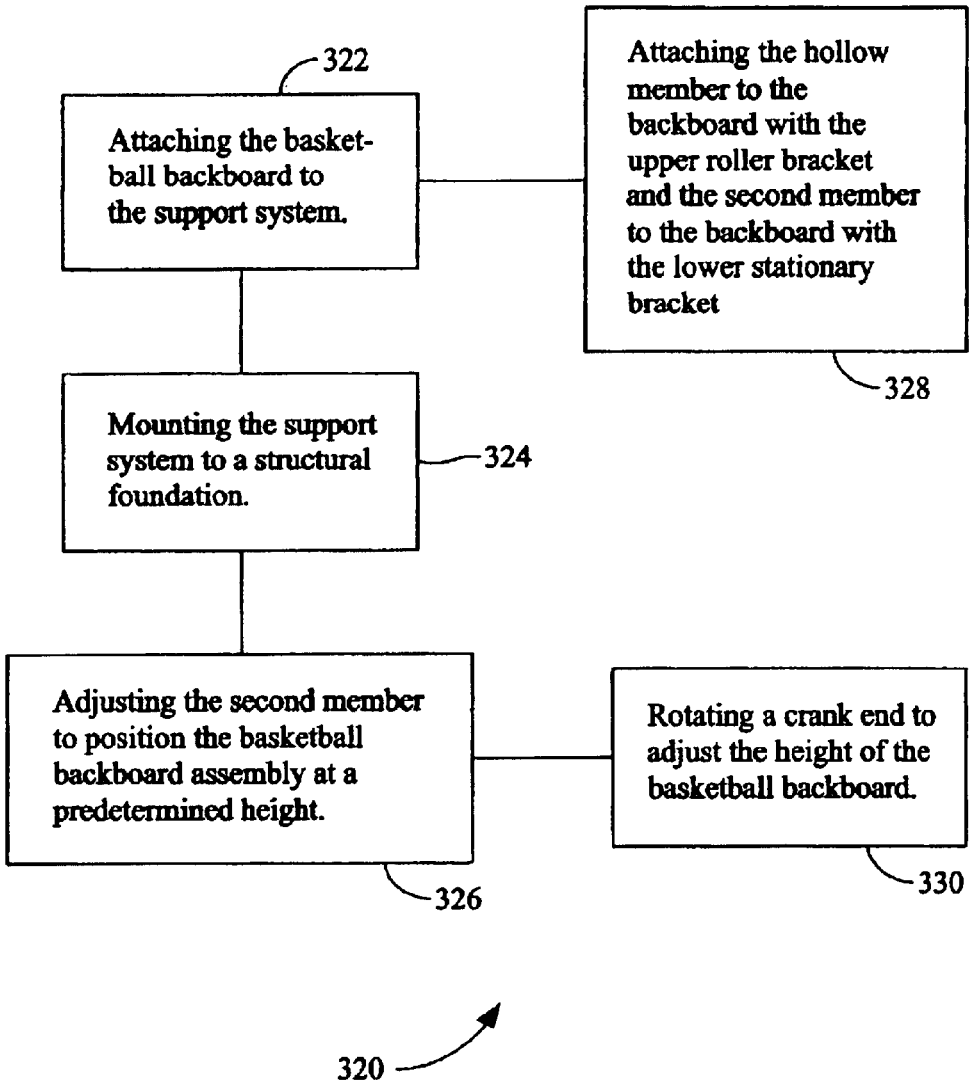
FIG. 8 is a flow chart illustrating an exemplary method for mounting a basketball backboard assembly to a structural foundation.

FIG. 8 is a flow chart 320 of a method for mounting a basketball backboard assembly to a structural foundation. In one embodiment, the method includes attaching 322 the backboard to the support system, and mounting 324 the support system to a structural foundation. In another embodiment, the method includes adjusting 326 the second member to position the backboard assembly at a predetermined height. In a further embodiment, the method includes attaching 328 the hollow member to the backboard with the upper roller assembly bracket, and the second member to the back board with the lower stationary bracket. In another embodiment, the method includes rotating 330 a crank end to adjust the height of the basketball backboard.

Exemplary embodiments of basketball backboard assemblies are described above in detail. The assemblies are not limited to the specific embodiments described herein, but rather, components of each assembly may be utilized independently and separately from other components described herein. Each basketball backboard assembly component can also be used in combination with other basketball backboard assembly components.

In summary, the present invention provides a mounting system for a basketball backboard assembly which combines a support system and an actuator system. The support system includes a plurality of hollow members which provide rigidity for the basketball backboard assembly. The actuator system includes a telescoping member and a plurality of bracket assemblies which permit the basketball backboard assembly to be rapidly adjusted by an individual. Furthermore, the actuator system includes a drive mechanism which can be motorized. As a result, a mounting system is provided which easily and reliably adjusts the height of a basketball backboard without requiring tedious on-site installation procedures.

While the invention has been described in terms of various specific embodiments, those skilled in the art will recognize that the invention can be practiced with modifications within the spirit and scope of the claims.

What is claimed is:

1. A basketball backboard assembly comprising:

a basketball backboard having a center axis of symmetry extending therethrough;

a hollow member comprising an outer surface and an inner surface;

a bracket connected to said basketball backboard and slidably coupled to said hollow member outer surface such that said basketball backboard is slidably movable with respect to said hollow member in a direction that is substantially parallel to said axis of symmetry;

a second member located at least partially within said hollow member in slidable contact with said hollow member such that an axis of symmetry of said second member is substantially co-linear with an axis of symmetry of said hollow member, said second member comprising an outer surface and an inner surface, at least one of said hollow member outer and inner surfaces defining a cross-sectional profile for said hollow member that is substantially similar that of a cross-sectional profile defined by at least one of said second member outer and inner surfaces;

a plurality of projections extending between said hollow member and said second member, wherein said plurality of projections are formed integrally with at least one of said hollow member and said second member; and an actuator connected to said second member and said hollow member, said actuator for providing relative movement between said second member and said hollow member.

2. An assembly in accordance with claim 1 wherein said actuator comprises a stationary assembly connected to said hollow member and a drive mechanism assembly connected to said second member and slidably coupled to said stationary member.

3. An assembly in accordance with claim 2 wherein said stationary assembly comprises a bracket attached to said hollow member and a nut attached to said bracket.

4. An assembly in accordance with claim 2 wherein said drive mechanism assembly comprises a threaded rod connected to said second member and received by said stationary assembly.

5. An assembly in accordance with claim 1 wherein said plurality of projections engage at least one of said hollow member and said second member in slidable contact.

6. An assembly in accordance with claim 1 wherein said plurality of projections are formed integrally with at least one of said hollow member and said second member.

7. An assembly in accordance with claim 6 wherein said plurality of projections and at least one of said hollow member and said second member formed with an extrusion process.

8. An assembly in accordance with claim 1 wherein said hollow member comprises a cavity, at least one of said hollow member inner and outer surfaces circumscribing said hollow member cavity.

9. An assembly in accordance with claim 1 wherein said second member comprises a cavity, at least one of said second member inner and outer surfaces circumscribing said second member cavity.

10. A method for mounting a backboard assembly to a structural foundation, wherein the backboard assembly includes a support system, said method comprising:

slidably coupling a hollow member including inner and outer surfaces to the backboard assembly having a center axis of symmetry by connecting a bracket to the backboard assembly and slidably coupling the bracket to the hollow member outer surface such that the basketball backboard is slidably movable with respect to the hollow member in a direction that is substantially parallel to the axis of symmetry;

slidably coupling a second member including inner and outer surfaces to the hollow member, wherein a cross-sectional profile of the second member defined by at least one of the second member inner and outer surfaces is substantially similar to a cross-sectional profile of the hollow member defined by at least one of the hollow member inner and outer surfaces, and such that a plurality of projections extend across a gap defined between the hollow member and the second member; and attaching the backboard to the support system.

11. A method in accordance with claim 10 further comprising adjusting the second member to position the backboard assembly at a predetermined height.

12. A method in accordance with claim 10 wherein slidably coupling a second member including inner and outer surfaces to the hollow member further comprises slidably coupling the second member to the hollow member such that a plurality of projections formed integrally with at least one of the second member and the hollow member extend through the gap defined between the hollow and second members.

13. A method in accordance with claim 10 further comprising rotating a crank end to adjust the height of the backboard.

14. A method in accordance with claim 10 wherein slidably coupling a second member including inner and outer surfaces to the hollow member further comprises coupling a second member to the hollow member, wherein at least one of the second member inner and outer surfaces circumscribes a cavity defined within the second member.

15. A method in accordance with claim 10 wherein attaching a hollow member including inner and outer surfaces to the backboard assembly further comprises coupling a hollow member to the backboard assembly, wherein at least one of the hollow member inner and outer surfaces circumscribes a cavity defined within the hollow member.

16. A method in accordance with claim 10, wherein bracket comprises a first roller assembly bracket, said method further comprising:

coupling the second member to the backboard with a second roller assembly bracket that is positioned to cooperate with the first roller assembly bracket.

17. A method in accordance with claim 10 further comprising moving the second member relative to the hollow member to adjust a relative height of the backboard assembly.

* * * * *